US006053434A

United States Patent [19]

Filipsson

[11] Patent Number: 6,053,434

[45] Date of Patent: Apr. 25, 2000

[54] DEVICE FOR APPLICATION OF FLUID

[75] Inventor: Mats Filipsson, Tyringe, Sweden

[73] Assignee: AB Volvo, Sweden

[21] Appl. No.: 08/981,961

[22] PCT Filed: Jul. 5, 1996

[86] PCT No.: PCT/SE96/00889

§ 371 Date: Apr. 20, 1998

§ 102(e) Date: Apr. 20, 1998

[87] PCT Pub. No.: WO97/02901

PCT Pub. Date: Jan. 30, 1997

[30] Foreign Application Priority Data

Jul. 12, 1995 [SE] Sweden ..... 9502566

[51] Int. Cl.[7] ..... B05B 15/08

[52] U.S. Cl. ..... 239/587.1; 239/551; 239/562; 239/587.2; 239/588

[58] Field of Search ..... 29/551, 562, 587.1, 29/587.2, 588

[56] References Cited

U.S. PATENT DOCUMENTS

| | | | |
|---|---|---|---|
| 3,826,431 | 7/1974 | Telge | 239/551 |
| 3,863,841 | 2/1975 | Berthoud | 239/551 X |
| 3,931,930 | 1/1976 | Waldrum | 239/587.2 X |
| 4,576,111 | 3/1986 | Slomianny . | |
| 4,821,673 | 4/1989 | Kirigakubo et al. | 239/587.2 X |
| 5,007,585 | 4/1991 | Kubacak et al. | 239/587.2 X |

FOREIGN PATENT DOCUMENTS

| | | |
|---|---|---|
| 0 307 506 | 3/1989 | European Pat. Off. . |
| 0 385 755 | 9/1990 | European Pat. Off. . |
| 80/02278 | 10/1980 | WIPO . |

*Primary Examiner*—Andres Kashnikow
*Assistant Examiner*—Robin O. Evans
*Attorney, Agent, or Firm*—Lerner, David, Littenberg, Krumholz & Mentlik, LLP

[57] ABSTRACT

Apparatus is disclosed for applying a fluid to a surface and adapted to be mounted on a holder, the apparatus is adjustable in a plurality of directions and includes at least one nozzle which can be rotated by the apparatus. The apparatus includes a feed line for supplying the fluid, a housing for transmitting rotary movement, a rotatable shaft having a longitudinal axis and rotatably mounting the housing, the at least one nozzle mounted on the rotatable shaft, and the feed line is connected to the housing, the housing including a first channel for supplying the fluid from the feed line through the housing, a second channel formed adjacent to the housing for supplying the fluid from the first channel to the rotatable shaft irrespective of the rotatable position of the rotatable shaft, and a third channel arranged at least partially in the rotatable shaft for supplying the fluid from the second channel to the at least one nozzle.

7 Claims, 3 Drawing Sheets

DEVICE FOR APPLICATION OF FLUID

FIELD OF THE INVENTION

The present invention relates to a device for the application of a fluid.

BACKGROUND OF THE INVENTION

A current device for the application of a fluid is in practice implemented as a rotatable spray gun which has a number of spray nozzles and is designed to be mounted on a robotic control device.

Spray guns are used when fluids, such as gases, liquids or plastic material, are to be sprayed or extruded onto a surface. One example of a field of application of such a spray gun is in the automobile industry, when bodies are to be surface treated or joints are to be sealed. Other fields of application are, of course, also possible. When the spray gun is used, it must be positioned carefully in relation to the surface onto which the material is to be applied. Conventional spray guns are usually furnished with a single nozzle having a fixed application direction. Redirection of the nozzle must then be carried out by turning the entire gun, which, however, takes considerable time, and can cause problems with accessibility in confined spaces. Redirection of a spray gun also places high demands on a robot's control instructions in order to achieve correct application with a high precision.

Rotating spray assemblies with several nozzles are known, for example, from PCT application Ser. No. WO 80/02278. This publication, however, shows a spray assembly with simultaneous feed to all of the nozzles, which severely limits the range of use of the assembly.

One object of the present invention is therefore to improve the accessibility, such as during extrusion or spraying, which then can proceed without the necessity for a tool change.

A further object of the present invention is to reduce the adjustment time which is necessary for an adjustment from a first spraying direction to a second spraying direction.

A further object of the present invention is to enable a changeover between different process steps, for example between spraying and extrusion, without an intervening tool change.

SUMMARY OF THE INVENTION

These and other objects have now been accomplished by the discovery of apparatus for the application of a fluid to a surface and adapted for mounting on a holder, the apparatus being adjustable between a plurality of directions and including at least one nozzle which can be rotated thereby, the apparatus including feed means for supplying the fluid, swivel means including a housing, a rotatable shaft having a longitudinal axis and rotatably mounting the housing, the at least one nozzle being mounted on the rotatable shaft, the feed means connected to the housing, and the housing including a first channel for supplying the fluid from the feed means through the housing, a second channel formed adjacent to the housing for supplying the fluid from the first channel to the rotatable shaft irrespective of the rotatable position of the rotatable shaft, and a third channel arranged at least partially in the rotatable shaft for supplying the fluid from the second channel to the at least one nozzle. Preferably the second channel comprises an annular channel disposed perpendicularly to the longitudinal axis of the rotatable shaft.

In accordance with one embodiment of the apparatus of the present invention, the at least one nozzle comprises three nozzles, each of the three nozzles being aimed in a different direction.

In accordance with another embodiment of the apparatus of the present invention, the apparatus includes at least one valve for controlling the supply of the fluid from the feed means to the at least one nozzle, the at least one valve being mounted on the housing, and being connected between the second channel and the third channel.

In accordance with another embodiment of the apparatus of the present invention, the housing includes an inner circumferential surface and the second channel comprises an annular channel open towards the inner circumferential surface of the housing.

In accordance with a preferred embodiment of the apparatus of the present invention, the housing and the rotatable shaft include a corresponding circumference therebetween, and wherein the third channel comprises an annular channel for the at least one valve and the at least one nozzle, the third channel being disposed at the corresponding circumference between the rotatable shaft and the housing and being open towards at least part of the corresponding circumference.

In accordance with another embodiment of the apparatus of the present invention, the apparatus includes a nozzle head for mounting the at least one nozzle, and a positioning lance including an extension channel for each of the at least one valve and each of the at least one nozzle for supplying the fluid from the rotatable shaft to the nozzle head, the positioning lance being disposed between the swivel means and the nozzle head, the swivel means comprising a first module, each of the at least one valve comprising a second module, the nozzle head comprising a third module, and the positioning lance comprising a fourth module.

In accordance with the present invention, by means of the possibility of switching between different nozzles, the extent of utilization of the device can be increased, which leads to reduced process times, and thus reduced production costs.

BRIEF DESCRIPTION OF THE DRAWINGS

The invention will be described in greater detail in the following detailed description, in which reference is made to the accompanying drawings, in which.

DETAILED DESCRIPTION

Figure 1:
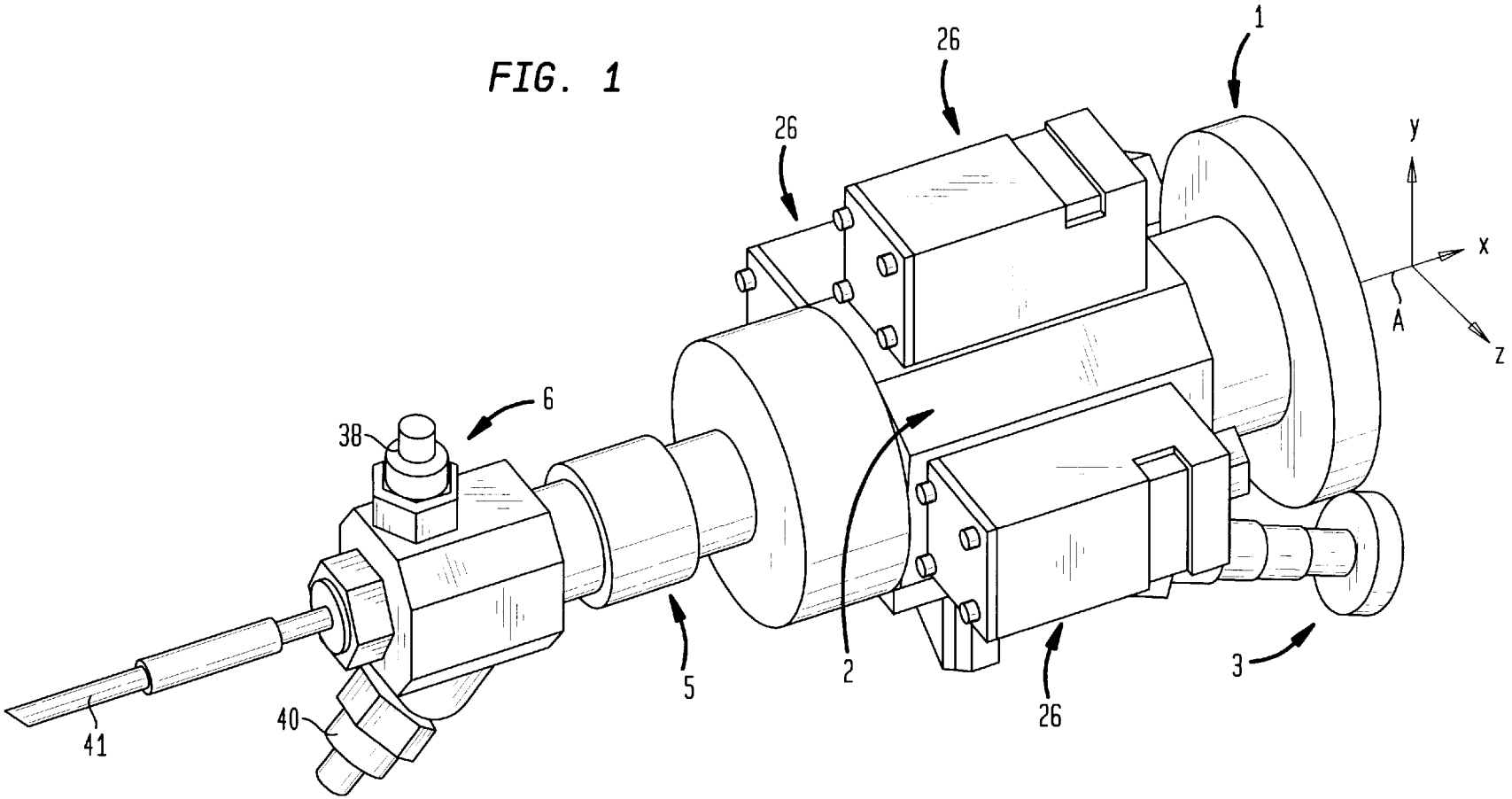
FIG. 1 is a side, perspective view of the outer construction of a device according to the present invention with a first nozzle head.

As is evident from the drawings the device for application of a fluid is designed as a gun-shaped tool which comprises five main components, namely an adapter 1 which serves to connect the gun with a robotic arm (not shown), a swivel means 2, which is capable of transmitting a rotary movement, a connection 3 to a feeder means 4 (see FIG. 2) for a fluid, such as a gas, a liquid or a plastic material, a positioning lance 5 and a head 6 having a number of spray or extrusion nozzles. The construction and respective function of these different primary components will be described below.

The adapter is constructed to be mounted on a robotic arm of any known type, either directly or by means of an intermediate adapter. A robotic arm can usually perform movements in six degrees of freedom, i.e. motion in three directions x, y and z, rotation about first and second axes, y and z, which are perpendicular to each other and which are at a right angle to the longitudinal direction of the robotic arm, and rotation about a third axis x which extends in the longitudinal direction of the robotic arm. The adapter 1 transmits the rotary motion about this third axis either because the adapter is rigidly rotated or because a shaft 7 located in the adapter is rotated with respect to the adapter. The shaft located in the adapter is connected to a shaft 8 rotatably held in the swivel means 2. This shaft can be an integral continuation of the shaft 7. In this case, the shafts 7 and 8 consist of a shaft constructed of one piece, which by means of a locking pin 9 is rotationally fixedly connected to the adapter 1 and arranged to be rotated by the robotic arm.

The swivel means 2 is outwardly limited by a housing 10, which has an outer mantle surface 11 and an inner cylindrical wall 12 and two end surfaces, 13 and 14. The mantle surface of the housing is substantially cylindrical, but other shapes of the mantle surface of the housing are of course also possible.

A first channel 15 is arranged through the mantle surface of the housing. The through channel has an inlet opening 16 and an outlet 17. The inlet opening connects the through channel to a supply channel 18, through which the material to be extruded or sprayed is furnished from the feed means 4 for the plastic material. The supply channel 18 is formed in the connection means 3, which connects the swivel means 2 to the feed means 4.

The outlet 17 is connected to a channel 19. This channel runs along the inner wall 20 of the housing 10 and connects the first through channel 15 with a number of second through channels 21. The second through channels each have an inlet opening 22 and an outlet 23.

The channel 19 is preferably shaped in the form of an annular groove in a bearing ring 24 arranged on the shaft 8. The groove can, alternatively, be milled in the inner wall of the housing.

The groove does not necessarily have to be closed, that is be ring-shaped; instead, it is also conceivable to arrange the groove as a branched groove with one or more endings.

Each outlet 23 connects the respective through channel 21 with an inlet channel 25 to a valve means 26. The valve means is maneuverable and can be opened and closed in some known manner. The valve means consists of an outlet channel 27 which is connected to an inlet 28 of a channel 29 running inside the housing, preferably substantially along the longitudinal axis of the housing, which coincides with the longitudinal axis A of the gun.

The channel 29 is, in turn, connected to a channel 30, which runs between the inner wall 20 of the housing and the channel 29. The channel 30 has an outlet 31, which is connected to a channel 32 which runs annularly around the shaft 8. The channel is partly limited by the peripheral surface 33 of the shaft. The channel is further limited by parts of the structure which rotatably hold the shaft 8 in the housing 10. The channel 32 is connected to an inlet 34 which leads to a longitudinal channel 35. This channel, in turn, is possibly connected, as is the case in the shown examples, by means of an extension channel 36 and the corresponding channel 42 in the head 6, to an outlet 37 in a spray or extrusion nozzle 38.

The extension channel 36 is formed in the lance 5 which is of a modular type and can be easily exchanged for a lance of a length which is suitable for the particular desired usage of the tool. The lance 5 is attached to the head 6 and the swivel means 2 in some known manner so that the head can also be modularly exchanged for heads with other nozzle types, dimensions or locations.

Since the channel 32 runs annularly around the shaft 8, the outlet 31 will be in constant communication with the channel 32 during rotation of the shaft 8. No interruptions of the supply of material will take place on account of the rotation.

The spray gun has at least two, and in the example shown in the drawing three, spray or extrusion nozzles, 38–41. To ensure the functioning of the gun, each of the nozzles has a channel between the common channel 19 and the nozzle. Each such channel is arranged in a manner corresponding to that of the channel described above with respect to the first nozzle 38. To each channel there is also arranged a maneuverable valve means. This implies that each nozzle can be opened and closed independently of the others. For this reason, it is possible to open one or more nozzles at the same time.

The bearing structure preferably comprises a number of ball bearings which run in their own grooves milled in the shaft. A number of annular channels, 32, one for each nozzle, is formed by sealing means 44 inserted between the housing and the shaft, which sealing means are in contact with the periphery of the shaft. These means are preferably fastened in the housing, but it is also conceivable that the rotation takes place against the inner wall of the housing. The channel 19 can also be formed through a means 45 inserted between the shaft and the housing.

The housing is closed axially by first and second end pieces, 46 and 47.

The head of the spray gun is, as has been stated above, arranged with at least two, for example three, spray or extrusion nozzles, each of which in the examples shown herein is aiming in different planes and/or directions. According to the example of FIG. 1, a nozzle is preferably aimed substantially in the direction of the axis A, i.e. in the x direction. A second nozzle 38 is preferably aimed substantially perpendicular to the longitudinal axis A, i.e. in the y direction. A third nozzle 40 is aimed in the x/y plane and preferably forms an angle of 40°–50° with the x axis.

Figure 2:
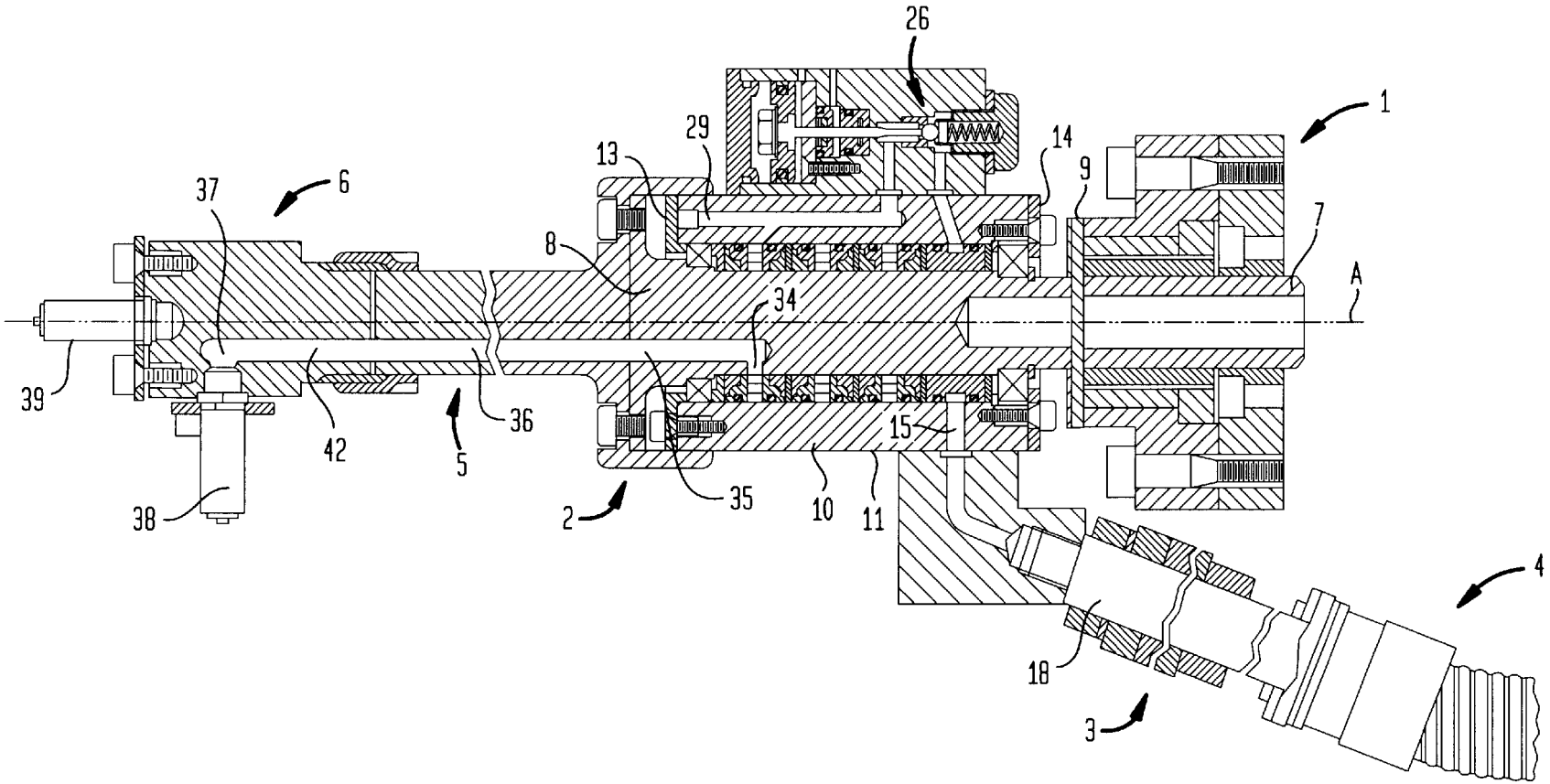
FIG. 2 is a side, elevational, partially sectioned view of another device according to the present invention, with a second nozzle head.

In the example shown in FIG. 2, two nozzles, 38 and 39, are illustrated, one of which is aimed axially and the other perpendicularly to the longitudinal axis A. A third nozzle is hidden behind the head and is, for example, aimed perpendicularly to the other two nozzles, 38 and 39, or forms a smaller or larger angle to one of the other nozzles.

Figure 3:
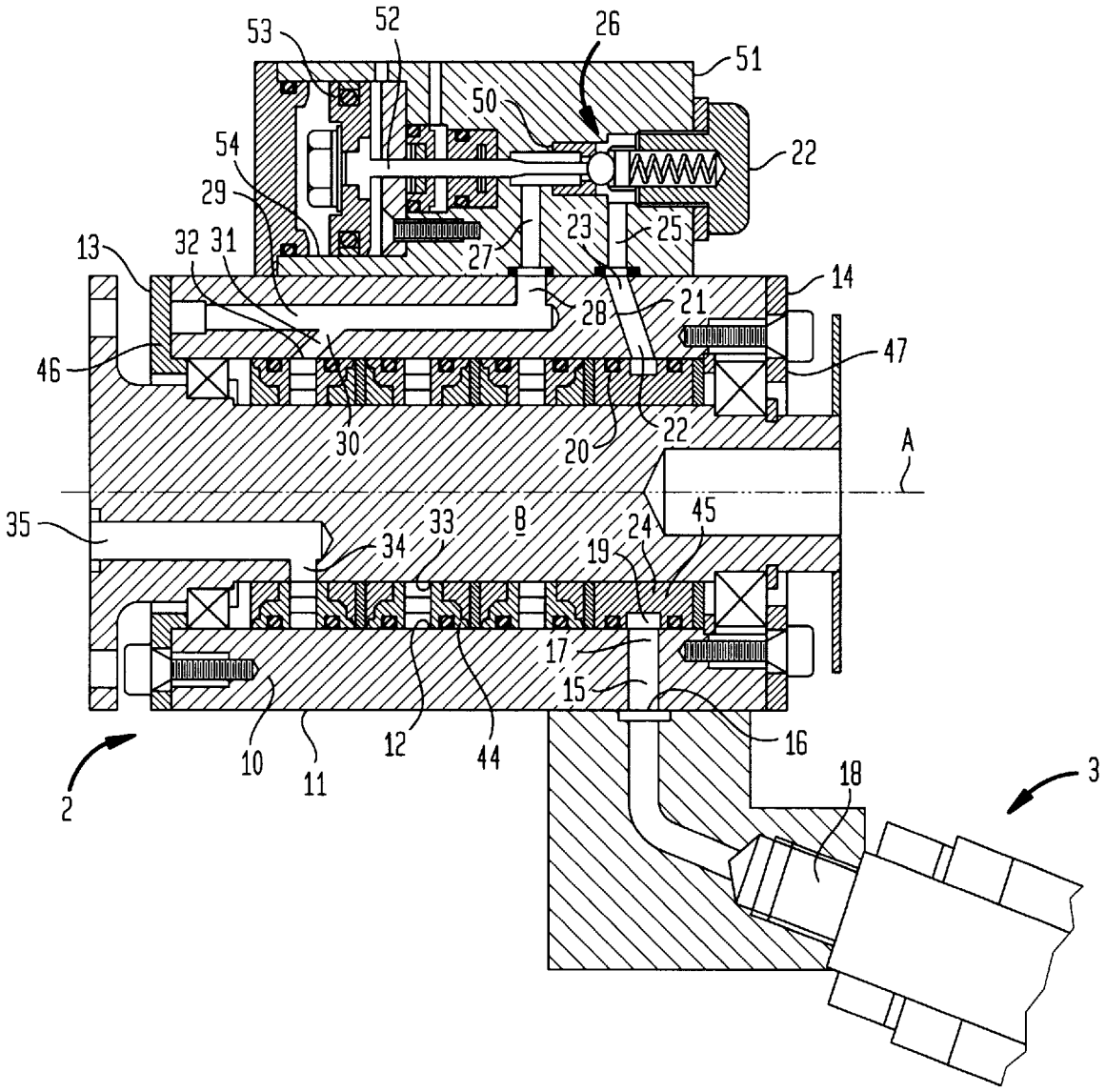
FIG. 3 is a side, elevational, enlarged, cross-sectional view through a module of a swivel means in a device according to the present invention.

The valve means 26 are, for example, constructed as shown in FIGS. 2 and 3 in the form of a ball valve with a valve body in the shape of a ball 50 which is urged by a spring 51 to a closed position onto a seat. Opening or closing of the valve is performed using is a control means, which in the example is shown in the form of an axially movable needle 57 which is moved by pneumatic means, for example an air controlled piston 53, movable within an air cylinder 54, which through an air hose (not shown) is connected to a pneumatic control device. Each valve means 26 with the corresponding control means, 52, 53 and 54, and channels, 25 and 27, is also assembled into a module which is easily replaceable.

The present invention is not restricted to the previous description nor to the examples shown in the drawings, but may be varied within the scope of the appended claims. For example, two or more nozzles can have the same direction of action. The feeding means for the incoming fluid can have more than one channel for the supply of different fluids. For example, air can be added in a separate channel all the way up to a special nozzle which has double nozzle holes, e.g.

one for each fluid. For each fluid a separate annular channel is required before the valves. Instead of a robotic arm, the gun can be mounted on other types of movable holders for automated adjustment between different positions and/or process steps. The valve means 26 can alternatively be mounted separated from the swivel means 2 and the gun. The number of nozzles can be two or more.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for the application of a fluid to a surface and adapted for mounting on a holder, said apparatus being adjustable between a plurality of directions and including at least one nozzle which can be rotated thereby, said apparatus including feed means for supplying said fluid, swivel means including a housing, a rotatable shaft having a longitudinal axis and rotatably mounting said housing, said at least one nozzle being mounted on said rotatable shaft, said feed means connected to said housing, and said housing including a first channel for supplying said fluid from said feed means through said housing, a second channel formed adjacent to said housing for supplying said fluid from said first channel to said rotatable shaft irrespective of the rotatable position of said rotatable shaft, and a third channel arranged at least partially in said rotatable shaft for supplying said fluid from said second channel to said at least one nozzle.

2. The apparatus of claim 1 wherein said second channel comprises an annular channel disposed perpendicularly to said longitudinal axis of said rotatable shaft.

3. The apparatus of claim 1 wherein said at least one nozzle comprises three nozzles, each of said three nozzles being aimed in a different direction.

4. The apparatus of claim 1 including at least one valve for controlling the supply of said fluid from said feed means to said at least one nozzle, said at least one valve being mounted on said housing, and being connected between said second channel and said third channel.

5. The apparatus of claim 1 wherein said housing includes an inner circumferential surface and said second channel comprises an annular channel open towards said inner circumferential surface of said housing.

6. The apparatus of claim 4 wherein said housing and said rotatable shaft include a corresponding circumference therebetween, and wherein said third channel comprises an annular channel for said at least one valve and said at least one nozzle, said third channel being disposed at said corresponding circumference between said rotatable shaft and said housing and being open towards at least part of said corresponding circumference.

7. The apparatus of claim 1 including a nozzle head for mounting said at least one nozzle, and a positioning lance including an extension channel for each of said at least one valve and each of said at least one nozzle for supplying said fluid from said rotatable shaft to said nozzle head, said positioning lance being disposed between said swivel means and said nozzle head, said swivel means comprising a first module, each of said at least one valve comprising a second module, said nozzle head comprising a third module, and said positioning lance comprising a fourth module.

* * * * *